US008316515B2

(12) United States Patent
Slank

(10) Patent No.: US 8,316,515 B2
(45) Date of Patent: Nov. 27, 2012

(54) MAGNETIC HOOK AND LOOP INTERFACE SYSTEM

(76) Inventor: Adam E. Slank, Austin, TX (US)

( * ) Notice: Subject to any disclaimer, the term of this patent is extended or adjusted under 35 U.S.C. 154(b) by 1 day.

(21) Appl. No.: 12/931,111

(22) Filed: Jan. 25, 2011

(65) Prior Publication Data

US 2011/0179605 A1 Jul. 28, 2011

Related U.S. Application Data

(60) Provisional application No. 61/336,607, filed on Jan. 25, 2010.

(51) Int. Cl.
*H01F 7/02* (2006.01)
*A44B 99/00* (2010.01)

(52) U.S. Cl. ..... 24/306; 24/303

(58) Field of Classification Search ..... 24/303, 24/306, 442–452
See application file for complete search history.

(56) References Cited

U.S. PATENT DOCUMENTS 4,781,231 A * 11/1988 Garcia et al. ..... 224/42.11
5,186,373 A * 2/1993 Taylor ..... 224/183
5,422,156 A * 6/1995 Billarant ..... 428/100
6,146,324 A * 11/2000 Engel ..... 600/15
6,187,031 B1 * 2/2001 Douglas ..... 607/112
6,611,962 B2 * 9/2003 Redwood et al. ..... 2/160
2003/0029006 A1 * 2/2003 Pelt et al. ..... 24/303
2009/0100648 A1 * 4/2009 Naftalin et al. ..... 24/306
2009/0108968 A1 * 4/2009 Tsai et al. ..... 335/219
2010/0275419 A1 * 11/2010 Millus ..... 24/306

* cited by examiner

*Primary Examiner* — Robert J Sandy
*Assistant Examiner* — Michael Lee
(74) *Attorney, Agent, or Firm* — David O. Simmons

(57) ABSTRACT

An interface system for hook and loop engagement structures comprises a first interface patch and a second interface patch. The first interface patch has a first major surface and a second major surface opposite the first major surface thereof. Hook engagement structures extend from the first major surface of the first interface patch. A first magnetic element is embedded within the first interface patch between said first and second major surfaces thereof. The second interface patch has a first major surface and a second major surface opposite the first major surface thereof. Loop engagement structures extend from the first major surface of the second interface patch. A second magnetic element is embedded within the second interface patch between said first and second major surfaces thereof.

19 Claims, 1 Drawing Sheet

FIG. 1
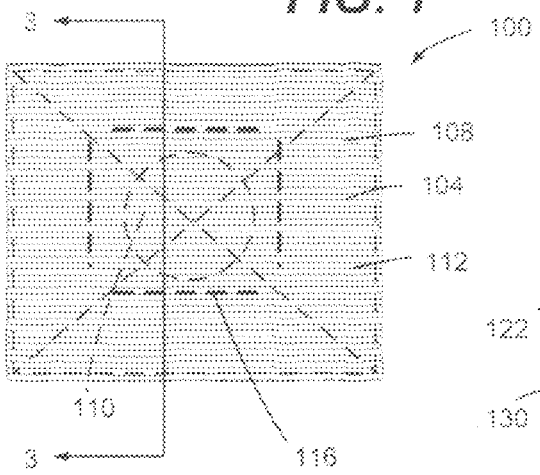
FIG. 2
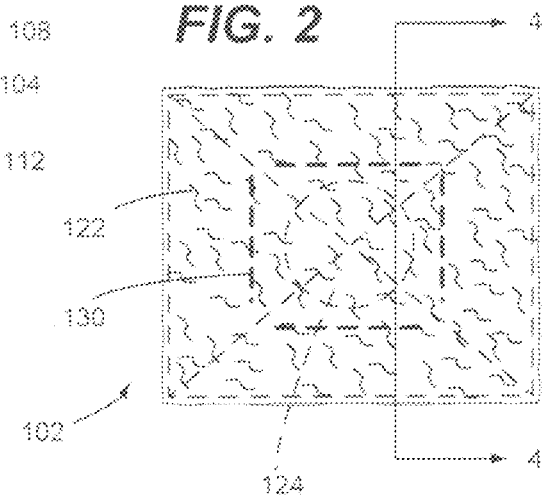
FIG. 5
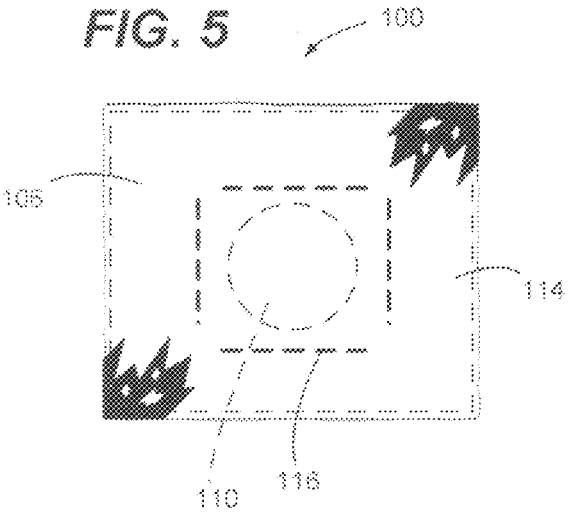
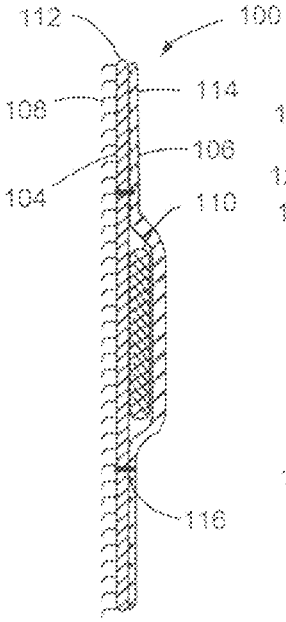
FIG. 3
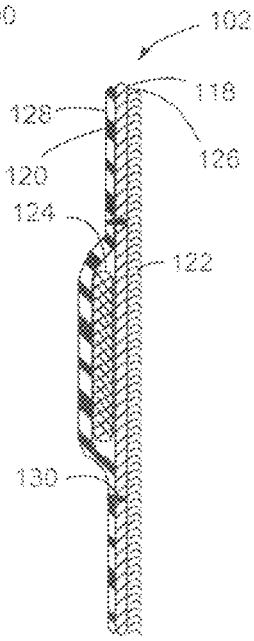
FIG. 4

MAGNETIC HOOK AND LOOP INTERFACE SYSTEM

CROSS REFERENCE TO RELATED APPLICATIONS

This non-provisional utility patent application claims priority from U.S. Provisional Patent Application having Ser. No. 61/336,607 filed Jan. 25, 2010 entitled "Magnetic Interface Patch for Hook and Loop and Other Similar Types of Surfaces", having a common applicant herewith and being incorporated herein in its entirety by reference.

FIELD OF THE DISCLOSURE

The disclosures made herein relate generally to fastening devices and, more particularly, to fastening devices having mating surfaces with interlocking engagement structures.

BACKGROUND

Various types of hook and loop fastening devices (e.g., Velcro brand hook and loop fastener) are well known. Such fasteners include a first material having a surface covered with hook engagement structures and a second material having a surface covered with loop engagement structures. When such hook and loop engagement structures are brought into contact with each other they become mechanically engaged with (i.e., interlocked with) each other thereby securing the first material to the second material. Separation of the two materials is performed by physically peeling them apart from each other. As such hook and loop fasteners provide a low-cost yet very effective means for securing two different objects together in a readily releasable manner.

Although hook and loop fasteners provide a low-cost and effective means for securing two different objects together in a readily releasable manner, there exist a number of shortcomings for using this type of fastening device in certain applications. One such shortcoming relates to using hook and loop fasteners in applications where the user desires to remain quiet. However, separation of the hook material from the loop material produces considerable noise. For example, in a combat or law enforcement situation, separation of the hook material from the loop material by a law enforcement or military personnel (e.g., such as when opening a pouch to retrieve a piece of equipment contained therein) can undesirably reveal their physical location. Similarly, such noise would be undesirable/adverse to a hunter while hunting or to a person otherwise engaged in an activity where such noise is undesirable/adverse. Another such shortcoming is that hook and loop material can become worn or contaminated over time, thereby reducing its effectiveness as a closure mechanism.

Therefore, a magnetic interface system that mounts between mating surfaces of a hook and loop fastener for inhibiting engagement of the hook engagement structure with the loop engagement structure and that thereby enables the magnetic interface system to provide selective engagement of two objects to which the hook and loop engagement structures are respectively attached would be advantageous, desirable and useful in that it overcomes shortcomings associated with conventional implementations of hook and loop fasteners.

SUMMARY OF THE DISCLOSURE

Embodiments of the present invention include a magnetic interface system for use with a hook and loop fastener. More specifically, such a magnetic interface system mounts between mating surfaces of a hook and loop fastener for inhibiting engagement of the hook engagement structure with the loop engagement structure and that thereby enables the magnetic interface system to provide selective engagement of two objects to which the hook and loop engagement structures are respectively attached. In this manner, a magnetic interface system configured in accordance with the present invention overcome shortcomings associated with conventional implementations of hook and loop fasteners.

In one embodiment of the present invention, an article of manufacture comprises a first interface body and a second interface body. The first interface body has a first major surface and a second major surface opposite the first major surface thereof. Interlock structures of a first configuration are provided on at least a portion of the first major surface of the first interface body. A first magnetic element is one of attached to the second major surface of the first interface body and embedded within the first interface body between said first and second major surfaces thereof. The second interface body has a first major surface and a second major surface opposite the first major surface thereof. Interlock structures of a second configuration are provided on at least a portion of the first major surface of the second interface body. A second magnetic element is one of attached to the second major surface of the second interface body and embedded within the second interface body between said first and second major surfaces thereof. The second configuration interlock structures are mechanically engagable with and separable from the first configuration interlock structures.

In another embodiment of the present invention, a magnetic hook and loop interface system comprises a first interface body and a second interface body. The first interface body has a first major surface and a second major surface opposite the first major surface thereof. Hook engagement structures are provided on at least a portion of the first major surface of the first interface body. A first magnetic element is embedded within the first interface body between the first and second major surfaces thereof. The second interface body has a first major surface and a second major surface opposite the first major surface thereof. Loop engagement structures are provided on at least a portion of the first major surface of the second interface body and wherein a second magnetic element is embedded within the second interface body between said first and second major surfaces thereof.

In another embodiment of the present invention, an interface system for hook and loop engagement structures comprises a first interface patch and a second interface patch. The first interface patch has a first major surface and a second major surface opposite the first major surface thereof. Hook engagement structures extend from the first major surface of the first interface patch. A first magnetic element is embedded within the first interface patch between said first and second major surfaces thereof. The second interface patch has a first major surface and a second major surface opposite the first major surface thereof. Loop engagement structures extend from the first major surface of the second interface patch. A second magnetic element is embedded within the second interface patch between said first and second major surfaces thereof.

These and other objects, embodiments, advantages and/or distinctions of the present invention will become readily apparent upon further review of the following specification, associated drawings and appended claims.

BRIEF DESCRIPTION OF THE DRAWINGS

FIG. 1 is a front view of a hook-carrying interface patch in accordance with an embodiment of the present invention.

FIG. 2 is a front view of a loop-carrying interface patch in accordance with an embodiment of the present invention FIG. 3 is a cross-sectional view taken along the line 3-3 in FIG. 1.

FIG. 4 is a cross-sectional view taken along the line 4-4 in FIG. 2.

FIG. 5 is a rear view of the hook-carrying interface patch shown in FIG. 1, which is substantially the same as a rear side view of the loop-carrying interface patch shown in FIG. 2.

DETAILED DESCRIPTION OF THE DRAWING FIGURES

FIGS. 1 and 2 show a hook-carrying interface patch 100 (i.e., a first interface body) and a loop-carrying interface patch 102 (i.e., a second interface body), respectively, configured in accordance with an embodiment of the present invention. Jointly, the hook-carrying interface patch 100 and the loop-carrying interface patch 102 define a magnetic interface system configured in accordance with an embodiment of the present invention. Such a magnetic interface system mounts between mating surfaces of a hook and loop fastener for inhibiting engagement of the hook engagement structure with the loop engagement structure and that thereby enables the magnetic interface system to provide selective engagement of two objects to which the hook and loop engagement structures are respectively attached. In this manner, a magnetic interface system configured in accordance with the present invention overcome shortcomings associated with conventional implementations of hook and loop fasteners (e.g., separation noise, loss of performance from contamination, etc).

Referring to FIGS. 1, 3, and 5, the hook-carrying interface patch 100 has a first major surface 104 and a second major surface 106 opposite the first major surface 104. Hook engagement structures 108 extend from the first major surface 104 of the hook-carrying interface patch 100. The hook engagement structures 108 are an example of interlock structures of a first configuration. The hook-carrying interface patch 100 has a magnet 110 (i.e., a magnetic element) embedded within the hook-carrying interface patch 100 between the first and second major surfaces 104, 106. Optionally, an element to which a magnet is attracted (e.g., a disk or plate made from a ferrous material (e.g., steel)) can be used in place of the magnet 110. It is disclosed herein that the magnet 110 can optionally be attached be attached to the second major surface 106 (e.g., by a mechanical fasteners such as a rivet).

A first layer of material 112 of the hook-carrying interface patch 100 defines the first major surface 104 of the hook-carrying interface patch 100. A second layer of material 114 of the hook-carrying interface patch 100 defines the second major surface 106 of the hook-carrying interface patch 100. Velcro brand hook material is an example of the first layer of material 112. Woven strap and webbing (i.e., a fabric) are examples of the second layer of material 114. The first and second layers of material 112, 114 are attached to each other adjacent to their respective perimeter edges. Examples of means by which the first and second layers of material 112, 114 can be attached to each other include, but are not limited to, stitching with thread, ultrasonic welding, laser welding, adhesive bonding, and the like. It is disclosed herein that additional layers of material (e.g., a stiffening layer) can be disposed between the first and second layers of material 112, 114. Such additional layers of material can be secured to the first layer of material 112 and/or the second layer of material 114 by means such as, for example, stitching with thread, ultrasonic welding, laser welding, adhesive bonding, and the like.

The magnet 110 is disposed between the first and second layers of material 112, 114 of the hook-carrying interface patch 100. As best shown in FIGS. 1 and 5, the magnet 110 is retaining at a desired position (e.g., a central area) of the hook-carrying interface patch 100 by a retaining border 116 encompassing the magnet 110. Examples of means for retaining the magnet 110 in such desired position include, but are not limited to, stitching with thread, ultrasonic welding, laser welding, adhesive bonding, and the like.

Referring to FIGS. 2 and 4, the loop-carrying interface patch 102 has a first major surface 118 and a second major surface 112 opposite the first major surface 118. Loop engagement structures 122 extend from the first major surface 118 of the loop-carrying interface patch 102. The loop engagement structures 108 are an example of interlock structures of a first configuration. The loop-carrying interface patch 102 has a magnet 124 (i.e., a magnetic element) embedded within the loop-carrying interface patch 102 between the first and second major surfaces 118, 120. Optionally, where the hook-carrying interface patch 100 includes the magnet 110, an element to which a magnet is attracted (e.g., a disk or plate made from a ferrous material (e.g., steel)) can be used in place of the magnet 124. It is disclosed herein that the hook-carrying interface patch 100 must have the magnet 110 and/or the loop-carrying interface patch 102 must include the magnet 124. It is disclosed herein that the magnet 110 can optionally be attached be attached to the second major surface 106 (e.g., by a mechanical fasteners such as a rivet).

A first layer of material 126 of the loop-carrying interface patch 102 defines the first major surface 118 of the loop-carrying interface patch 102. A second layer of material 128 of the loop-carrying interface patch 102 defines the second major surface 120 of the loop-carrying interface patch 102. Velcro brand loop material is an example of the first layer of material 126. Woven and strap and webbing (i.e., a fabric) are examples of the second layer of material 128. The first and second layers of material 126, 128 are attached to each other adjacent to their respective perimeter edges. Examples of means by which the first and second layers of material 126, 128 can be attached to each other include, but are not limited to, stitching with thread, ultrasonic welding, laser welding, adhesive bonding, and the like. It is disclosed herein that additional layers of material (e.g., a stiffening layer) can be disposed between the first and second layers of material 126, 128. Such additional layers of material can be secured to the first layer of material 126 and/or the second layer of material 128 by means such as, for example, stitching with thread, ultrasonic welding, laser welding, adhesive bonding, and the like.

The magnet 124 is disposed between the first and second layers of material 126, 128 of the loop-carrying interface patch 102. As best shown in FIGS. 1 and 5, the magnet 124 is retaining at a desired position (e.g., a central area) of the loop-carrying interface patch 102 by a retaining border 130 encompassing the magnet 124. Examples of means for retaining the magnet 124 in such desired position include, but are not limited to, stitching with thread, ultrasonic welding, laser welding, adhesive bonding, and the like.

In view of the preceding disclosure, a skilled person will appreciate that the hook-carrying interface patch 100 can have the hook engagement structures 108 mechanically engagable with and separable from loop engagement structures of an article (e.g., a prior art storage implement such as a pouch having a hook and loop closure structure) and the hook-carrying interface patch 100 can similarly have the loop engagement structures 122 mechanically engagable with and separable from hook engagement structures of the article. In this manner, the article can temporarily or permanently be converted from having a hook and loop engagement structure (e.g., closure structure) to having a magnetic engagement structure (e.g., closure mechanism). Specifically, during use, the magnetic element of the hook-carrying interface patch 100 is engagable with and separable from the magnetic element of the loop-carrying interface patch 102 while the hook engagement structure 108 and the loop-engagement structure 122 both remain engaged with their respective engagement structure of the article (i.e., force required to separate the magnetic elements is less than the force required to separate the hook and loop interfaces). Preferably, the first and second interface patches 100, 102 are sized to prevent hook and loop engagement structures of the article from coming into contact with each other when the magnetic elements of the interface patches 100, 102 are brought into contact with each other.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An article of manufacture, comprising:

a first interface body having a first major surface and a second major surface opposite the first major surface thereof, wherein a first side of a first layer of material of the first interface body defines the first major surface thereof, wherein interlock structures of a first configuration are only provided on at least a portion of the first major surface of the first interface body, wherein a first magnetic element is one of attached to the second major surface of the first interface body and embedded within the first interface body between said first and second major surfaces thereof, wherein the second major surface of the first interface body is devoid of interlock structures of a second configuration that interlock with the interlock structures of the first configuration, and wherein the first layer of material resides in-between said first configuration interlock structures of the first interface body and the first magnetic element; and a second interface body having a first major surface and a second major surface opposite the first major surface thereof, wherein a first side of a first layer of material of the second interface body defines the first major surface thereof, wherein interlock structures of the second configuration are only provided on at least a portion of the first major surface of the second interface body, wherein a second magnetic element is one of attached to the second major surface of the second interface body and embedded within the second interface body between said first and second major surfaces thereof, wherein the first layer of material resides in-between said second configuration interlock structures of the first interface body and the second magnetic element, wherein the second major surface of the second interface body is devoid of interlock structures of the first configuration, and wherein said second configuration interlock structures are mechanically engagable with and separable from said first configuration interlock structures.

2. The article of claim 1 wherein at least one of said magnetic elements is a magnet.

3. The article of claim 1 wherein:

one of said magnetic elements is a magnet; and the other one of said magnetic elements is a steel element.

4. The article of claim 1 wherein:

said first configuration interlock structure is a hook engagement structure; and said second configuration interlock structure is a loop engagement structure.

5. The article of claim 4 wherein at least one of said magnetic elements is a magnet.

6. The article of claim 1 wherein:

a second layer of material of the first interface body defines the second major surface thereof;

a second layer of material of the second interface body defines the second major surface thereof;

the first magnetic element is disposed between said first and second layers of material of the first interface body; and the second magnetic element is disposed between said first and second layers of material of the second interface body.

7. The article of claim 6 wherein:

said first configuration interlock structure is a hook engagement structure; and said second configuration interlock structure is a loop engagement structure.

8. The article of claim 6 wherein at least one of said magnetic elements is a magnet.

9. The article of claim 6 wherein:

one of said magnetic elements is a magnet; and the other one of said magnetic elements is a steel element.

10. A magnetic interface system for hook and loop engagement structures, comprising:

a first interface body having a first major surface and a second major surface opposite the first major surface thereof, wherein a first side of a first layer of material of the first interface body defines the first major surface thereof, wherein hook engagement structures are only provided on at least a portion of the first major surface of the first interface body, wherein a first magnetic element is embedded within the first interface body between said first and second major surfaces thereof, wherein the second major surface of the first interface body is devoid of loop engagement structures that interlock with said hook engagement structures of the first configuration, and wherein the first magnetic element is secured against a second side of the first layer of material of the first interface body; and a second interface body having a first major surface and a second major surface opposite the first major surface thereof, wherein a first side of a first layer of material of the second interface body defines the first major surface thereof, wherein loop engagement structures are only provided on at least a portion of the first major surface of the second interface body, wherein a second magnetic element is embedded within the second interface body between said first and second major surfaces thereof, wherein the second major surface of the second interface body is devoid of hook engagement structures that interlock with said loop engagement structures, and wherein the second magnetic element is secured against a second side of the first layer of material of the first interface body.

11. The device of claim 10 wherein at least one of said magnetic elements is a magnet.

12. The device of claim 10 wherein:

one of said magnetic elements is a magnet; and the other one of said magnetic elements is a steel element.

13. The device of claim 10 wherein:

a second layer of material of the first interface body defines the second major surface thereof;

a second layer of material of the second interface body defines the second major surface thereof;

the first magnetic element is disposed between said first and second layers of material of the first interface body; and the second magnetic element is disposed between said first and second layers of material of the second interface body.

14. The device of claim 13 wherein at least one of said magnetic elements is a magnet.

15. The device of claim 13 wherein:

one of said magnetic elements is a magnet; and the other one of said magnetic elements is a steel element.

16. A magnetic interface system for hook and loop engagement structures, comprising:

a first interface patch having a first major surface and a second major surface opposite the first major surface thereof, wherein a first side of a first layer of material of the first interface patch defines the first major surface thereof, wherein a first side of a second layer of material of the first interface patch defines the second major surface thereof, wherein hook engagement structures extend from the first major surface of the first interface patch, wherein the second major surface of the first interface patch is devoid of said hook engagement structures and loop engagement structures that interlock with said hook engagement structures, and wherein a first magnetic element is embedded within the first interface patch between a second side of the first layer of material of the first interface patch and a second side of the second layer of material of the first interface patch; and a second interface patch having a first major surface and a second major surface opposite the first major surface thereof, wherein a first side of a first layer of material of the second interface patch defines the first major surface thereof, wherein a first side of a second layer of material of the second interface patch defines the second major surface thereof, wherein loop engagement structures extend from the first major surface of the second interface patch, wherein the second major surface of the second interface patch is devoid of said loop engagement structures and hook engagement structures that interlock with said loop engagement structures, and wherein a second magnetic element is embedded within the second interface patch between a second side of the first layer of material of the second interface patch and a second side of the second layer of material of the second interface patch.

17. The system of claim 16 wherein at least one of said magnetic elements is a magnet.

18. The system of claim 16 wherein at least one of said magnetic elements is a magnet.

19. The system of claim 16 wherein:

one of said magnetic elements is a magnet; and the other one of said magnetic elements is a steel element.

* * * * *